US010697634B2

(12) United States Patent
Haeny et al.

(10) Patent No.: US 10,697,634 B2
(45) Date of Patent: Jun. 30, 2020

(54) INNER COOLING SHROUD FOR TRANSITION ZONE OF ANNULAR COMBUSTOR LINER

(71) Applicant: General Electric Company, Schenectady, NY (US)

(72) Inventors: Daniel Haeny, Untersiggenthal (CH); Pirmin Schiessel, Ehrendingen (CH); Martin Zajadatz, Kussaberg (DE); Thomas Christen, Niederrohrdorf (CH)

(73) Assignee: General Electric Company, Schenectady, NY (US)

( * ) Notice: Subject to any disclaimer, the term of this patent is extended or adjusted under 35 U.S.C. 154(b) by 130 days.

(21) Appl. No.: 15/914,669

(22) Filed: Mar. 7, 2018

(65) Prior Publication Data

US 2019/0277500 A1 Sep. 12, 2019

(51) Int. Cl.

| | |
|---|---|
| ***F23R 3/00*** | (2006.01) |
| ***F01D 9/02*** | (2006.01) |
| ***F23R 3/50*** | (2006.01) |
| *F23R 3/54* | (2006.01) |

(52) U.S. Cl.

CPC ..... *F23R 3/002* (2013.01); *F01D 9/023* (2013.01); *F23R 3/50* (2013.01); *F05D 2260/201* (2013.01); *F23R 3/54* (2013.01); *F23R 2900/03044* (2013.01)

(58) Field of Classification Search

CPC ..... F01D 9/023; F05D 2260/36; F23M 5/04; F23M 5/08; F23M 5/085; F23R 3/002; F23R 3/005; F23R 3/50; F23R 3/52; F23R 3/54; F23R 3/58; F23R 3/60; F23R 2900/00017; F23R 2900/03044

See application file for complete search history.

(56) References Cited

U.S. PATENT DOCUMENTS

| | | | | |
|---|---|---|---|---|
| 8,272,220 | B2 | 9/2012 | Haehnle et al. | |
| 8,413,449 | B2 | 4/2013 | Haehnle et al. | |
| 8,434,313 | B2 | 5/2013 | Tschuor et al. | |
| 8,516,823 | B2 | 8/2013 | Tschuor et al. | |
| 8,758,502 | B2 * | 6/2014 | Nienburg | C04B 35/04 106/600 |
| 9,708,920 | B2 | 7/2017 | Tschuor et al. | |
| 2010/0037621 | A1 * | 2/2010 | Tschuor | F23R 3/002 60/752 |

(Continued)

*Primary Examiner* — Scott J Walthour

(74) *Attorney, Agent, or Firm* — Dority & Manning, P.A.

(57) ABSTRACT

An annular combustor includes an inner liner shell and an outer liner shell defining an interior volume through which combustion gases flow in a gas flow direction from a forward end to an aft end. A cooling shroud is attached radially outward of the inner liner shell, forming a cooling passage between the inner liner shell and the cooling shroud. The cooling passage directs air in an air flow direction opposite to the gas flow direction. The cooling shroud is assembled from circumferentially adjoined cooling shroud segments, and the distance between the cooling shroud segments and the inner liner shell is greater at the forward end than at the aft end. Fastening elements are distributed across an axial length of the cooling shroud segments in circumferentially staggered rows. Each forwardmost fastening element is disposed immediately adjacent to a curved portion at the forward end of each respective cooling shroud segment to reduce vibration.

16 Claims, 6 Drawing Sheets

(56) References Cited

U.S. PATENT DOCUMENTS

| | | | | |
|---|---|---|---|---|
| 2011/0113785 | A1* | 5/2011 | Tschuor | F01D 9/023 60/752 |
| 2011/0113790 | A1* | 5/2011 | Haehnle | F01D 9/023 60/806 |
| 2011/0135451 | A1* | 6/2011 | Tschuor | F02C 7/28 415/170.1 |
| 2015/0354826 | A1 | 12/2015 | Rudel et al. | |

* cited by examiner

INNER COOLING SHROUD FOR TRANSITION ZONE OF ANNULAR COMBUSTOR LINER

TECHNICAL FIELD

The present disclosure relates to the field of combustion technology and, more particularly, to an annular combustor of a power-generating gas turbine. Specifically, the present disclosure is directed to an inner cooling shroud for a transition zone of an annular combustor liner.

BACKGROUND

A modern industrial gas turbine, as may be used for electrical power generation, may be designed with an annular combustor or an array of can-annular combustors. In the case of a gas turbine with an annular combustor, the combustion chamber is defined circumferentially between the side walls and axially between the inlet plane and the discharge plane. Such a gas turbine is described in commonly assigned U.S. Pat. No. 8,434,313 and is shown in FIGS. 1 through 4. The gas turbine 10, which is shown in detail in FIGS. 1 and 2, has a turbine casing 11 in which a rotor 12 that rotates around a longitudinal axis 27 is housed. A compressor 17, which produces a compressed air flow 2 used for combustion and cooling, is positioned at one end of the rotor 12 and includes blades mounted on the rotor 12. A turbine 13 is arranged downstream of the compressor 17, the turbine 13 also having blades that are mounted on the rotor 12. The compressor 17 compresses air that flows as a compressed air flow 2 into a plenum 14 defined by the turbine casing 11. In the plenum 14, an annular combustor 100 is arranged concentrically around the longitudinal axis 27.

The combustor 100 includes an inner liner shell 33 (proximate to the axis 27) and an outer liner shell 23 (distal to the axis 27), which form the side walls of the combustor 100 and which are radially spaced apart from one another to define an annular interior volume. At the upstream (or head) end of the combustor 100, a front plate 19 spans between the inner liner shell 33 and the outer liner shell 23 to define a combustion zone 15 (sometimes referred to as "zone one"). The front plate 19 defines the inlet plane of the combustion zone 15. Mounted to the front plate 19 at the head end of the combustor 100 is a ring of burners 16, which, for example, may be designed as double-cone burners or EV-burners and which inject a fuel-air mixture into the combustion zone 15. The combustion gases 26 produced by the burners 16 travel from the combustion zone 15 through a transition zone 25 (sometimes referred to as "zone two") before being discharged from the aft end of the combustor 100 to perform work within the turbine 13. The inner liner shell 33 and the outer liner shell 23 are shaped such that the combustion zone 15 is an annular region of uniform cross-section, while the transition zone 25 defines an annular region of diminishing cross-section to the aft end and discharge plane.

The outer shell 23 and the inner shell 33 are cooled using air 2 from the compressor 17, as discussed below. In order to promote the cooling, an outer cooling shroud 21 is disposed radially outward of the outer shell 23 (that is, distal to the axis 27), thus defining an annular cooling passage 22 between the outer shell 23 and the outer cooling shroud 21. Similarly, an inner cooling shroud 31 is disposed radially outward of the inner shell 33 (that is, toward the axis 27), defining an annular cooling passage 32 between the inner shell 33 and the inner cooling shroud 31. The inner cooling shroud 31 and the outer cooling shroud 21 are connected to the respective inner and outer liner shells 33, 22 by fastening elements 24 (as shown in FIGS. 2 and 4). The inner cooling shroud 31 and the outer cooling shroud 21 may be segmented circumferentially and/or axially (e.g., into upstream cooling shrouds disposed radially outward of the combustion zone 15 and downstream cooling shrouds disposed radially outward of the transition zone 25).

Air 2 from the compressor 17 flows into the cooling passages 22, 32, at the aft end of the combustor 100. Air 2 flows along the liner shells 23, 33 of the combustor 100 in a cooling air flow direction opposite to the direction of the hot gas flow 26 within the combustion zone 15 and the transition zone 25, the air 2 thereby convectively cooling the liner shells 23, 33. At the forward end of the combustor 100, air 2 from the cooling passages 22, 32 is directed into a combustor dome 18 that defines an air plenum 58 from which the air 2 flows into the burners 16 where it mixes with fuel from a fuel line 47. A portion of the air 2 that is directed into the combustor dome 18 flows through the front plate 19, as front plate cooling air 20. The front plate cooling air 20 flows directly into the combustion zone 15.

The inner liner shell 33 and the outer liner shell 23 may be constructed as shell elements or half-shells. When using half-shells, it is desirable for installation and maintenance reasons to secure the half-shells along a parting plane 29 (shown in FIG. 3), which allows an upper half of the shell 23, 33 (e.g., upper half 33*a* of inner shell 33 in FIG. 3) to be detached from the lower half (e.g., lower half 33*b* of inner shell 33 in FIG. 3). The parting plane 29 correspondingly has two parting plane welded seams 30, which, in the example of the General Electric GT13E2 gas turbine, are located at the level of the machine axis 27 (i.e., at the 3 o'clock and 9 o'clock positions).

FIG. 4 illustrates a portion of the inner liner halves 33*a*, 33*b*, at the parting plane 29 and at the aft end of the annular combustor 100 (that is, forming the tapering portion defining the transition zone 25). The welded seam 30 between the inner liner halves 33*a*, 33*b* may be covered with a cooling trough 43 having a plurality of cooling holes (not shown) defined therethrough.

The fastening elements 24, which secure the cooling shroud(s) 31 to the inner liner 33, include a C-shaped bracket 44 and a bolt 45. The bolt 45 is welded or otherwise affixed (optionally, with a washer) to the center portion of the C-shaped bracket, and the respective ends of the bracket 44 are welded or otherwise affixed to the outer surface of the inner liner half 33*a*, 33*b*. The fastening elements 24 are aligned along a common plane or axis 49 from the forward end of the inner liner half 33*a*, 33*b* to the aft end of the inner liner half 33*a*, 33*b*. The cooling shrouds 31 are disposed over the fastening elements 24 and are secured thereto by a threaded nut 46 (shown in FIG. 2), optionally with a washer.

The inner and outer liner shells 33, 23 of the gas turbine 10 are known to be thermally and mechanically highly stressed during operation. The strength properties of the material of the shells 23, 33 are greatly dependent upon temperature. In order to keep the material temperature below the maximum permissible material temperature level, the shells 23, 33 are convectively cooled, as described above. One challenge to be overcome in the design of the cooling shrouds 21, 31 is the accommodation of thermal expansion, which occurs during the operation of the gas turbine 10. Another challenge to be overcome in the design of the cooling shrouds 21, 31 is the reduction of vibrations of the cooling shrouds 21, 31, as may be expected to occur during the operation of the gas turbine 10, which may negatively impact the part life and shorten the maintenance intervals of the combustor 100.

SUMMARY

According to a first aspect of the present disclosure, an annular combustor for a gas turbine is provided. The annular combustor includes an inner liner shell and an outer liner shell that define an interior volume. The annular combustor is configured to direct combustion gases in a gas flow direction through the interior volume from a forward end of the annular combustor to an aft end of the annular combustor. A cooling shroud is attached at a distance radially outward of the inner liner shell, forming a cooling passage between the inner liner shell and the cooling shroud. The cooling passage is configured to direct cooling air in an air flow direction opposite to the gas flow direction. The cooling shroud includes and is assembled from individual cooling shroud segments circumferentially adjoined to each other, and the distance between the cooling shroud segments and the inner liner shell is greater at the forward end than at the aft end. A plurality of distributed fastening elements, which fastens the cooling shroud segments on the inner liner shell, is distributed across an axial length of the cooling shroud segments in circumferentially staggered rows. Each fastening element of a set of forwardmost fastening elements of the plurality of distributed fastening elements is disposed immediately adjacent to a curved portion at the forward end of each respective cooling shroud segment.

According to another aspect of the present disclosure, a gas turbine is provided. The gas turbine includes a compressor configured to produce a compressed air flow, a turbine coupled to the compressor, and an annular combustor disposed between the compressor and the turbine. The annular combustor includes an inner liner shell and an outer liner shell that define an interior volume. The annular combustor is configured to direct combustion gases in a gas flow direction through the interior volume from a forward end of the annular combustor to an aft end of the annular combustor. A cooling shroud is attached at a distance radially outward of the inner liner shell, forming a cooling passage between the inner liner shell and the cooling shroud. The cooling passage is configured to direct cooling air in an air flow direction opposite to the gas flow direction. The cooling shroud includes and is assembled from individual cooling shroud segments circumferentially adjoined to each other, and the distance between the cooling shroud segments and the inner liner shell is greater at the forward end than at the aft end. A plurality of distributed fastening elements, which fastens the cooling shroud segments on the inner liner shell, is distributed across an axial length of the cooling shroud segments in circumferentially staggered rows. Each fastening element of a set of forwardmost fastening elements of the plurality of distributed fastening elements is disposed immediately adjacent to a curved portion at the forward end of each respective cooling shroud segment.

BRIEF DESCRIPTION OF THE DRAWINGS

The specification, directed to one of ordinary skill in the art, sets forth a full and enabling disclosure of the present system and method, including the best mode of using the same. The specification refers to the appended figures, in which.

DETAILED DESCRIPTION

To clearly describe the current cooling shrouds, certain terminology will be used to refer to and describe relevant machine components within the scope of this disclosure. To the extent possible, common industry terminology will be used and employed in a manner consistent with the accepted meaning of the terms. Unless otherwise stated, such terminology should be given a broad interpretation consistent with the context of the present application and the scope of the appended claims. Those of ordinary skill in the art will appreciate that often a particular component may be referred to using several different or overlapping terms. What may be described herein as being a single part may include and be referenced in another context as consisting of multiple components. Alternatively, what may be described herein as including multiple components may be referred to elsewhere as a single part.

In addition, several descriptive terms may be used regularly herein, as described below. As used herein, "downstream" and "upstream" are terms that indicate a direction relative to the flow of a fluid, such as the working fluid through the turbine engine. The term "downstream" corresponds to the direction of flow of the fluid, and the term "upstream" refers to the direction opposite to the flow (i.e., the direction from which the fluid flows). The terms "forward" and "aft," without any further specificity, refer to relative position, with "forward" being used to describe components or surfaces located toward the front (or compressor) end of the engine, and "aft" being used to describe components located toward the rearward (or turbine) end of the engine. Additionally, the terms "leading" and "trailing" may be used and/or understood as being similar in description as the terms "forward" and "aft," respectively. "Leading" may be used to describe, for example, a surface of a turbine blade over which a fluid initially flows, and "trailing" may be used to describe a surface of the turbine blade over which the fluid finally flows.

Figure 1:
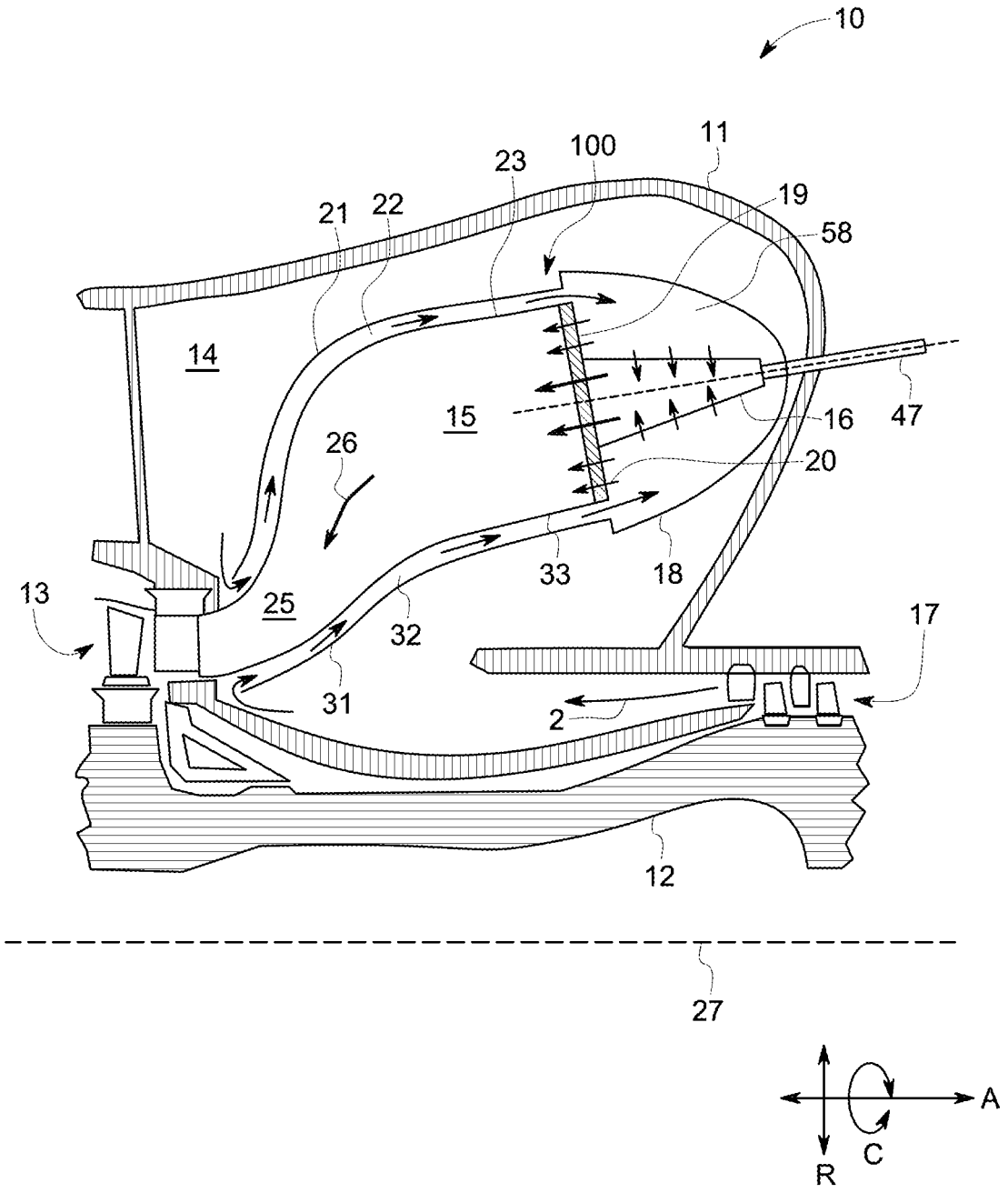
FIG. 1 (PRIOR ART)
FIG. 1 schematically illustrates a longitudinal cross-sectional view of a gas turbine having a cooled annular combustor, according to the prior art.
Figure 5:
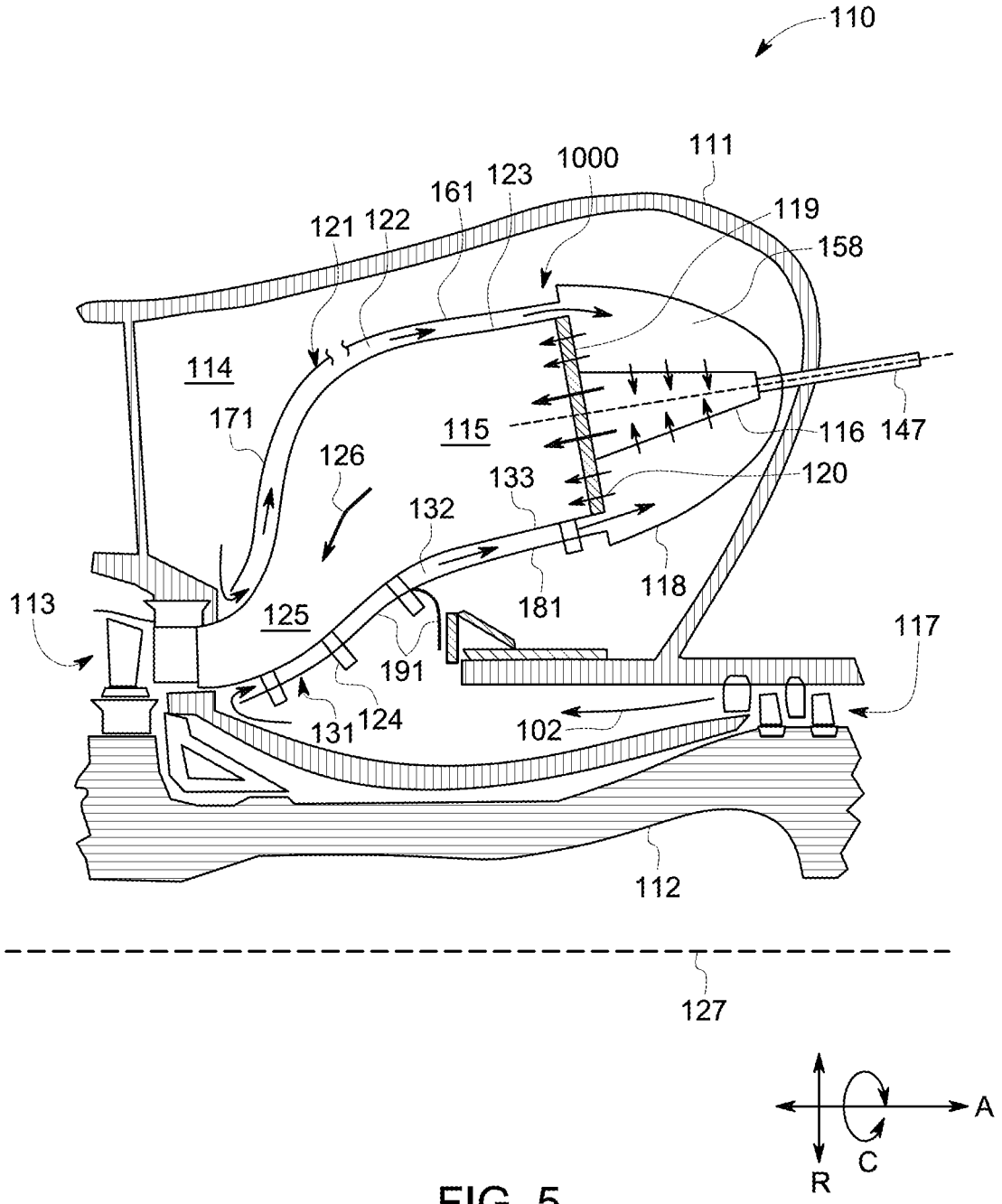
FIG. 5 schematically illustrates a longitudinal cross-sectional view of a gas turbine having a cooled annular combustor, according to the present disclosure.

It is often required to describe parts that are at differing radial, axial and/or circumferential positions. As shown in FIGS. 1 and 5, the "A" axis represents an axial orientation. As used herein, the terms "axial" and/or "axially" refer to the relative position/direction of objects along axis A, which is substantially parallel with the axis of rotation of the turbine system (in particular, the rotor section) or the longitudinal axis of the annular combustor. As further used herein, the terms "radial" and/or "radially" refer to the relative position or direction of objects along an axis "R", which is substantially perpendicular with axis A and intersects axis A at only one location. Finally, the term "circumferential" refers to movement or position around axis A (e.g., in a rotation "C"). The term "circumferential" may refer to a dimension extending around a center of any suitable shape (e.g., a polygon) and is not limited to a dimension extending around a center of a circular shape.

The cooling shrouds, which are subject of the present disclosure, provide the function of defining an air plenum around the respective liner shells through which cooling air is delivered along the outside of the respective liner shells. The cooling shrouds are formed in circumferential cooling shroud segments, which seal in relation to each other to prevent leakage from the air plenum. The cooling shroud segments along the inner liner shell are installed in a "blind" manner, because the inner liner shell blocks line-of-sight of the cooling shroud segments. In addition to being temperature resistant and capable of withstanding axial and radial movement during transient operating states, the cooling shroud segments should be designed and/or mounted in such a manner as to minimize their natural vibration during operation. The cooling shroud segments of the present disclosure address these needs.

FIG. 5 illustrates a gas turbine 110, which is similar to the gas turbine 10 of FIG. 1. The gas turbine 110 includes a turbine casing 111 in which a rotor 112 that rotates around a longitudinal axis 127 is housed. A compressor 117, which produces a compressed air flow 102 used for combustion and cooling, is positioned at one end of the rotor 112 and includes blades mounted on the rotor 112. A turbine 113 is arranged downstream of the compressor 117, the turbine 113 also having blades that are mounted on the rotor 112. The compressor 117 compresses air that flows as a compressed air flow 102 into a plenum 114 defined by the turbine casing 111. In the plenum 114, an annular combustor 1000 is arranged concentrically around the longitudinal axis 127.

The combustor 1000 includes an inner liner shell 133 (proximate to the axis 127) and an outer liner shell 123 (distal to the axis 127), which form the side walls of the combustor 1000 and which are radially spaced apart from one another to define an annular interior volume (115, 125). At the upstream (or head) end of the combustor 1000, a front plate 119 spans between the inner liner shell 133 and the outer liner shell 123 to define a combustion zone 115 (sometimes referred to as "zone one"). The front plate 119 defines the inlet plane of the combustion zone 115. Mounted to the front plate 119 at the head end of the combustor 1000 is a ring of burners 116, which, for example, may be designed as double-cone burners or EV-burners and which inject a fuel-air mixture into the combustion zone 115. The combustion gases 126 produced by the burners 116 travel from the combustion zone 115 through a transition zone 125 (sometimes referred to as "zone two") before being discharged from the aft end of the combustor 1000 to perform work within the turbine 113. The inner liner shell 133 and the outer liner shell 123 are shaped such that the combustion zone 115 is an annular region of uniform cross-section, while the transition zone 125 defines an annular region of diminishing cross-section to the aft end and discharge plane.

Figure 2:
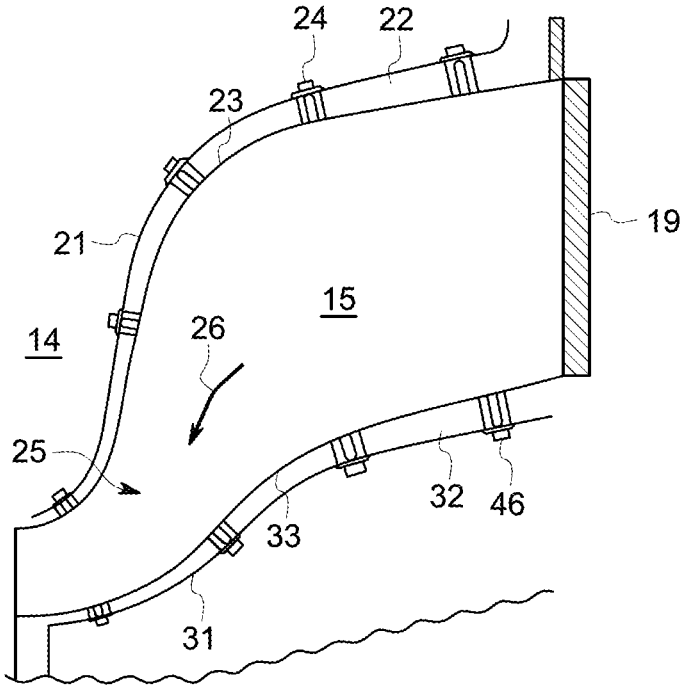
FIG. 2 (PRIOR ART)
FIG. 2 is a side view of the annular combustor of FIG. 1, which illustrates the cooling shrouds affixed to the respective inner and outer liner shells.
Figure 3:
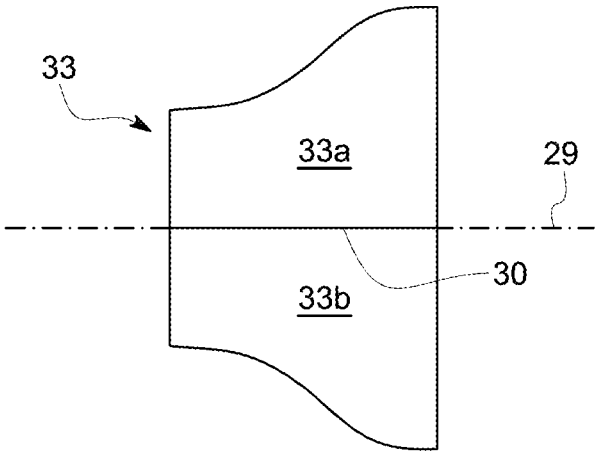
FIG. 3 (PRIOR ART)
FIG. 3 shows a schematic side view of the inner liner shell of the annular combustor of FIG. 1, which illustrates the division of the inner shell in a parting plane into two half-shells.
Figure 4:
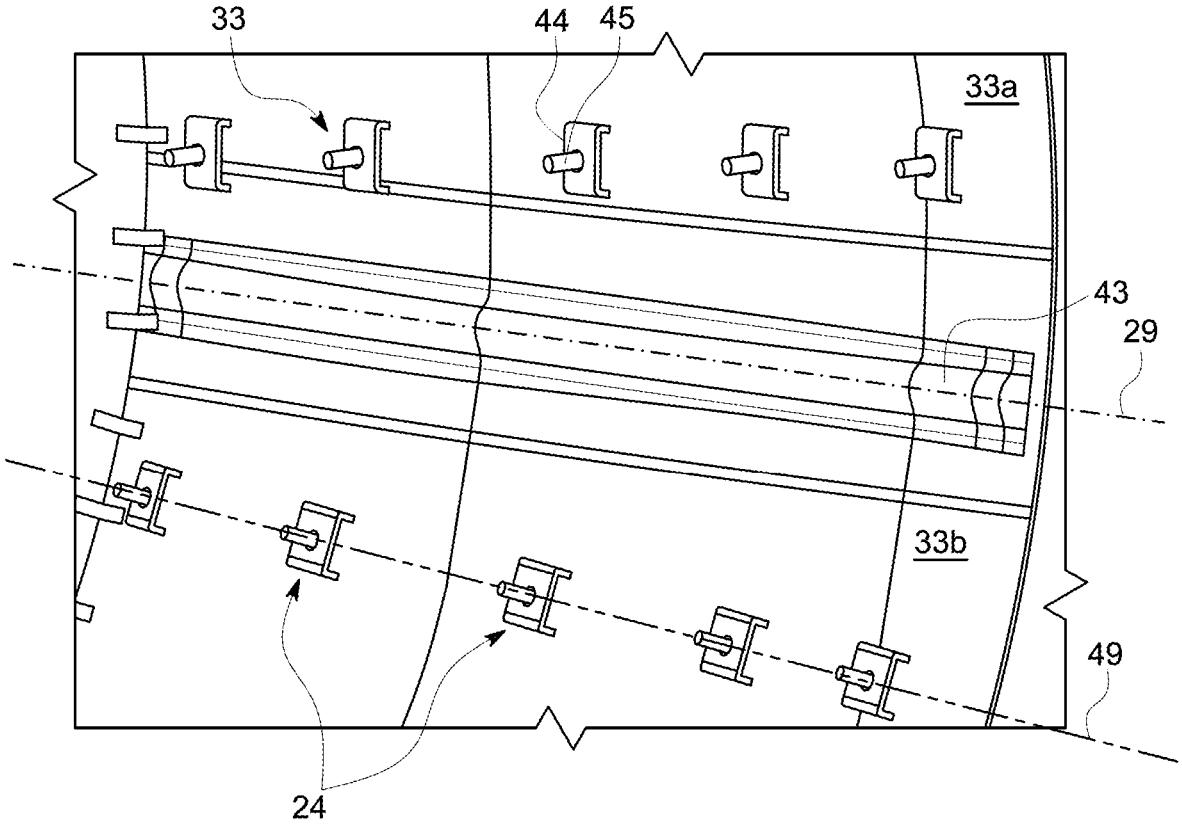
FIG. 4 (PRIOR ART)
FIG. 4 is an enlarged perspective view of a portion of the inner liner half-shells of FIG. 3.

The outer shell 123 and the inner shell 133 are cooled using air from the compressor 117, as discussed below. In order to promote the cooling, an outer cooling shroud 121 is disposed radially outward of the outer shell 123 (that is, distal to the axis 127), thus defining an annular cooling passage 122 between the outer shell 123 and the outer cooling shroud 121. As illustrated in FIG. 5, the outer cooling shroud 121 may be divided into a forward outer cooling shroud 161 and an aft outer cooling shroud 171. The forward and aft outer cooling shrouds 161, 171 may be attached to the outer liner shell 123 by fastening elements (such as those shown in FIG. 2, but not shown in FIG. 5).

Similarly, an inner cooling shroud 131 is disposed radially outward of the inner shell 133 (that is, toward the axis 127), defining an annular cooling passage 132 between the inner shell 133 and the inner cooling shroud 131. The inner cooling shroud 131 may be divided into a forward inner cooling shroud 181 and an aft inner cooling shroud 191. The aft inner cooling shrouds 191 may be attached to the inner liner shell 133 by fastening elements 124 (also shown in FIGS. 7 and 9).

The inner cooling shroud 131 and the outer cooling shroud 121 may be segmented circumferentially, as well as axially (the axial segmentation being described above as "forward" and "aft"). As described further herein, the aft inner cooling shroud 181 may be circumferentially divided into inner cooling shroud segments 200, as shown in FIG. 6.

Air 102 from the compressor 117 flows into the cooling passages 122, 132, at the aft end of the combustor 1000. Air 102 flows along the liner shells 123, 133 of the combustor 1000 in a cooling air flow direction opposite to the direction of the hot gas flow 126 within the combustion zone 115 and the transition zone 125, the air 102 thereby convectively cooling the liner shells 123, 133. At the forward end of the combustor 1000, air 102 from the cooling passages 122, 132 is directed into a combustor dome 118 that defines an air plenum 158 from which the air 102 flows into the burners 116 where it mixes with fuel from a fuel line 147. A portion of the air 102 is directed into the combustor dome 118 flows through the front plate 119, as front plate cooling air 120. The front plate cooling air 120 cools the front plate 119 and flows directly into the combustion zone 115.

Figure 6:
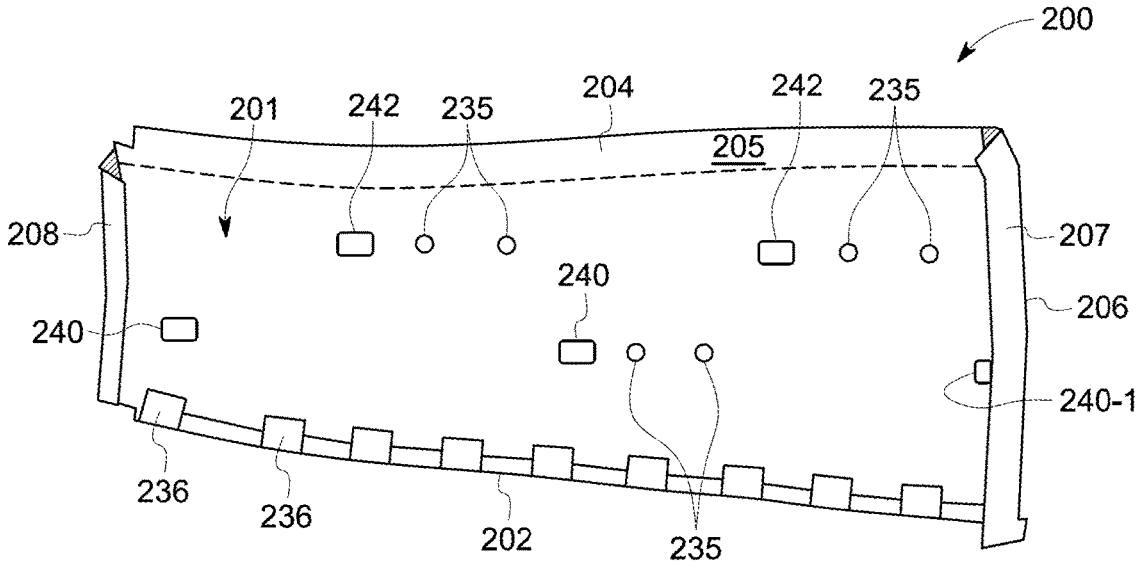
FIG. 6 is a perspective view of an inner cooling shroud segment, according to the present disclosure.

FIG. 6 shows a radially outer surface of an exemplary aft inner cooling shroud segment 200. Each aft inner cooling shroud segment 200 is axially symmetrically constructed and extends in the axial direction for a span equal or approximately equal to the length of the transition zone 125. The aft inner cooling shroud segment 200 includes a first axial edge 202, a second axial edge 204 opposite the first axial edge, a forward end portion 206 connecting the first axial edge 202 and the second axial edge 204 at a forward end, and an aft end portion 208 connecting the first axial edge 202 and the second axial edge 204 at an aft end. The forward end portion 206 defines a curved section 207 (shown in FIG. 9) that curves radially outward from a plane defining a majority of the body 201 of the inner cooling shroud segment 200. The aft end portion 208 also defines a curved portion, in a bell-mouth shape, to facilitate the flow of compressed air 102 into the annulus 132 between the inner liner shell 133 and the cooling shroud 131 (formed from multiple interlocked cooling shroud segments 200, as described below).

The aft inner cooling shroud segments 200 adjoin each other in an overlapping manner along their axial edges 202, 204. Along the first axial edge 202, overlapping elements 236 are welded onto the body 201 of the aft inner cooling shroud segment 200. The overlapping elements 236 overlap the second axial edge 204 of a circumferentially adjacent cooling shroud segment 200 in an overlap region 205 proximate to the edge 204, thus providing a form-fit between the adjacent cooling shroud segments 200.

The body 201 of the cooling shroud segment 200 defines a first row of fastening holes 240 that are distributed between the forward end portion 206 and the aft end portion 208. As shown in FIG. 6, the fastening hole 240-1 is closest to the forward end portion 206 and is referred to herein as the "forwardmost" fastening hole, which is part of a row of forwardmost fastening holes distributed around the circumference of the cooling shroud 231. A second row of fastening holes 242 is circumferentially offset from the first row of fastening holes 240, and its holes 240 are distributed axially between the forwardmost fastening hole 240-1 and the aft-most fastening hole 240. In the exemplary embodiment illustrated, the first row of fastening holes 240 includes three fastening holes, and the second row of fastening holes 242 includes two fastening holes. Different numbers of fastening holes 240, 242 (other than three and two, respectively) may be used in one or both rows.

In axial alignment with one or more of the fastening holes 240, 242, in the following region of the fastening holes 240, 242, cooling holes 235 may be provided in the cooling shroud segments 200 to permit air 102 to flow through the cooling shroud segment 200 and impinge on the inner liner shell 133. The mass flow of air 102 enters the annulus 132 between the cooling shroud segments 200 of the inner cooling shroud 131 and the inner liner shell 133 by passing around the bell-mouth curved portion of the respective aft ends 208 of the cooling shroud segments 200. Because the velocity of the air flowing the cooling holes 235 is relatively high compared to the incoming mas flow of air 102, the heat transfer coefficient for the impinging air through holes 235 is increased, and the wall temperature of the inner liner shell 133 is reduced.

Figure 7:
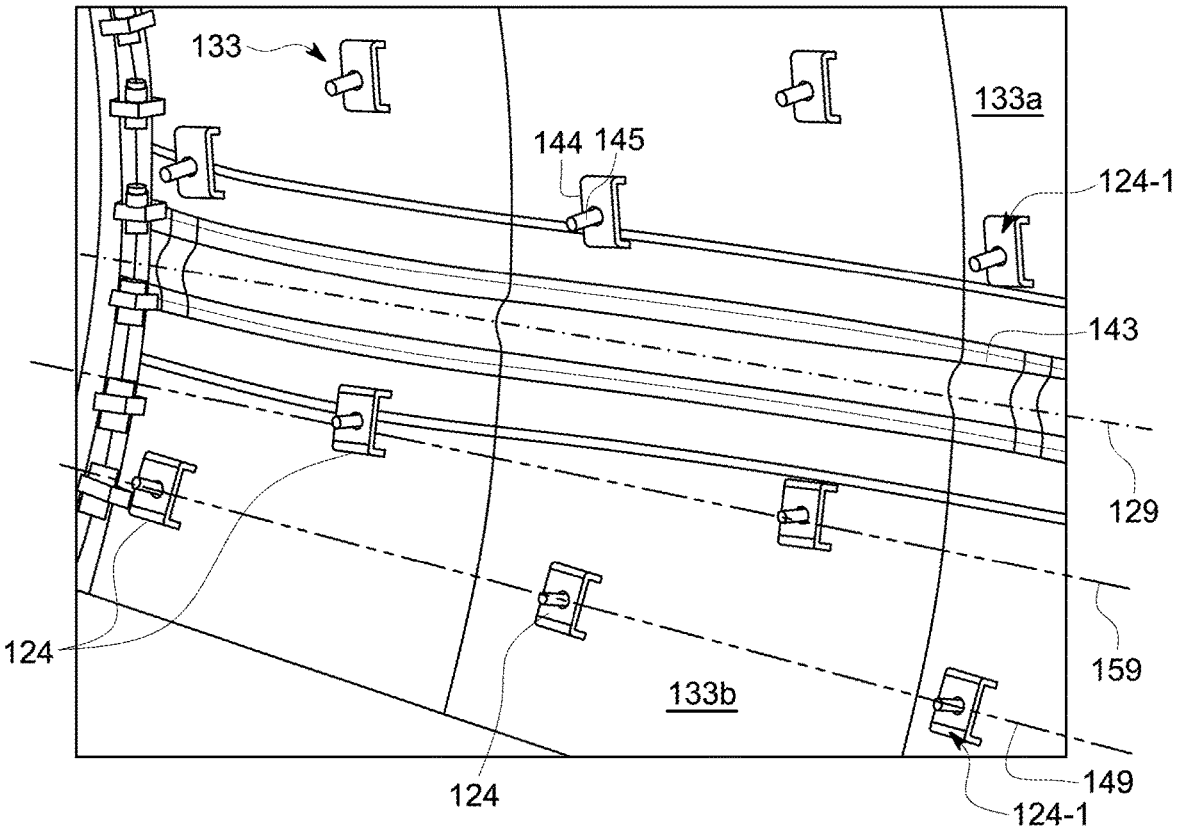
FIG. 7 is an enlarged perspective view of a portion of the inner liner half-shells of FIG. 5, according to the present disclosure.

FIG. 7 illustrates a portion of the inner liner 133 at the parting plane 129 between respective inner liner halves 133*a*, 133*b* and at the aft end of the annular combustor 1000 (that is, forming the tapering portion defining the transition zone 125). The welded seam (not shown) between the inner liner halves 133*a*, 133*b* may be covered with a cooling trough 143 having a plurality of cooling holes (not shown) defined therethrough.

The cooling shroud segments 200 are fastened on the associated inner liner shell 133 by fastening elements 124 that are arranged in a distributed manner projecting from the outer surface of the inner liner shell 133 (as shown in FIG. 7). In the area of the liner shell 133 to be covered by a corresponding cooling shroud segment 200, some of the fastening elements 124 are aligned in a first row along a common plane 149 from the forward end of the inner liner shell 133 to the aft end of the inner liner shell 133. A second row of fastening elements 124 is circumferentially offset from the first row of fastening elements 124, and its fastening elements 124 are distributed axially along a second common plane 159 between the forwardmost fastening element 124-1 and the aft-most fastening element 124 in the first row.

The fastening elements 124 include a C-shaped bracket 144 and a bolt 145. The bolt 145 is welded or otherwise affixed (optionally, with a washer) to the center portion of the C-shaped bracket 144, and the respective ends of the bracket 144 are welded or otherwise affixed to the outer surface of the inner liner shell 133. The cooling shroud segments 200 are disposed over the fastening elements 124, such that the bolts 145 extend through the fastening holes 240, 242, and the bolts 145 are secured by a threaded nut 146 (shown in FIGS. 8 and 9), optionally with a washer. The fastening holes 240, 242 may be provided with an elliptical or slot shape to facilitate alignment of bolts 145 with the fastening holes 240, 242 and to accommodate thermal expansion when the gas turbine is in operation.

Figure 8:
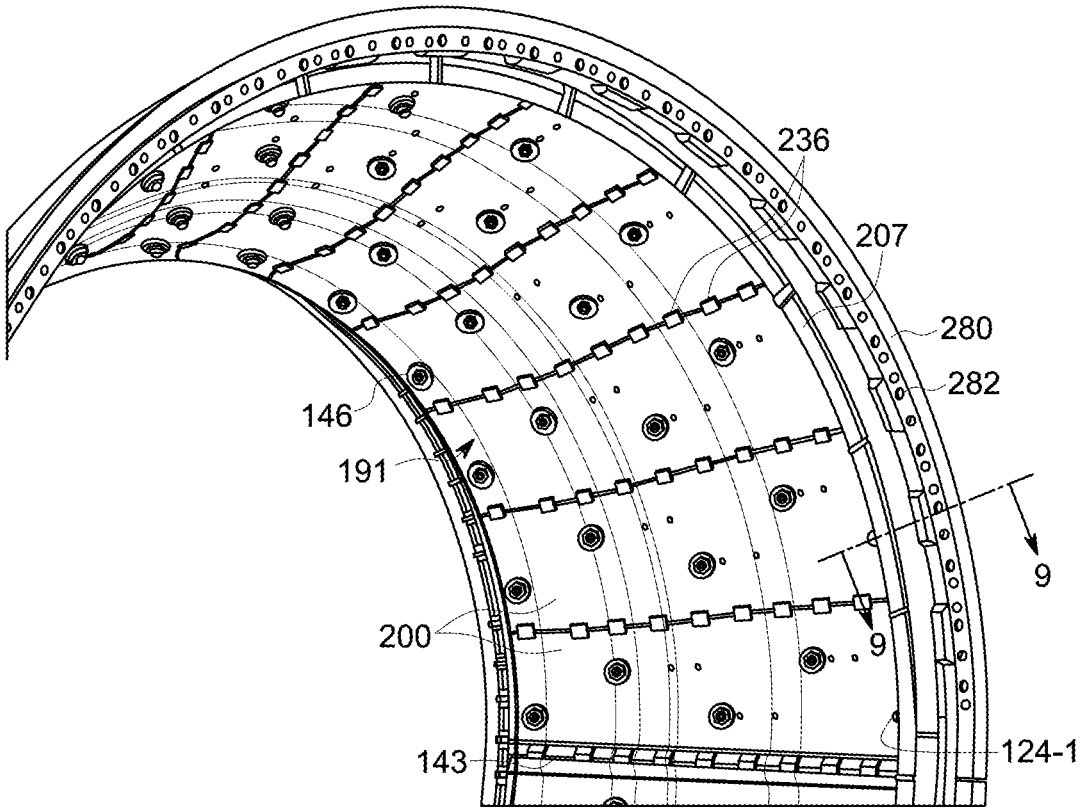
FIG. 8 is a perspective view of a portion of the inner liner shell of FIG. 5, on which an array of inner cooling shroud segments of FIG. 6 is installed.
Figure 9:
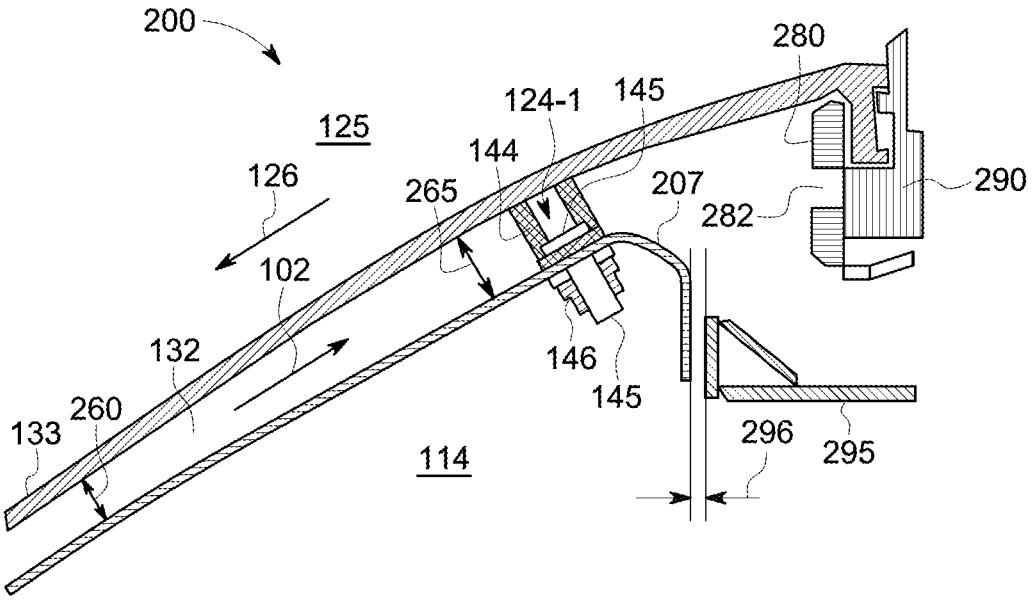
FIG. 9 is a cross-sectional view of a forwardmost portion of the inner liner and cooling shroud segments, as taken along line IX-IX of FIG. 8.

FIG. 8 is a perspective view of a portion of the aft portion 191 of the inner liner shell 133, on which an array of inner cooling shroud segments 200 is installed. FIG. 9 illustrates a portion of the inner liner shell 133 and cooling shroud segment 200, as taken along line IX-IX of FIG. 8.

The cooling shroud segments 200 are mounted to the inner liner shell 133, via staggered rows of fastening elements 124 secured with nuts 146, which are visible in FIG. 8. The cooling shroud segments 200 interlock with one another, as discussed above, with the overlapping elements 236 of each segment 200 overlapping a circumferentially adjacent segment 200. The cooling trough 143 covers the parting plane 129 (not shown). The inner liner shell 133 is connected to a zone-two inner support ring 280, as shown in FIG. 9. The inner support ring 280 defines a plurality of bore holes 282 therethrough for attaching the aft portion 191 of the inner liner shell 133 to the forward portion 181 of the inner liner shell 133, as shown in FIG. 5.

Turning now to FIG. 9, the inner liner shell 133 is positioned radially inward of the inner cooling shroud segment 200. The inner liner shell 133 is connected to a zone-one inner segment carrier 290 and secured in position, via bolts (not shown) through bore holes 282, by the zone-two inner support ring 280. The inner cooling shroud segment 200 includes a curved forward section 207 whose end is axially spaced from a zone-one cover ring 295 by a gap 296. The gap 296 permits thermal expansion and prevents the inner cooling shroud segments 200 from being thermally distorted during operation of the gas turbine 110.

At an aft end of the inner cooling shroud segment 200, the annulus 132 between the cooling shroud segment 200 and the inner liner shell 133 defines a first distance 260. At a forward end of the inner cooling shroud segment 200, proximate to the forwardmost fastening element 124-1, the annulus 132 between the cooling shroud segment 200 and the inner liner shell 133 defines a second distance 265 that is greater than the first distance 260.

The fastening element 124-1 includes the bracket 144 mounted to the outer surface of the inner liner shell 133, and the bolt 145 positioned through the bracket 144 and the inner cooling shroud segment 200. The bolt 145 is secured by the nut 146, optionally, with a washer. The fastening element 124, which is the forwardmost fastening element 124-1, is positioned at the inlet to the curved section 207 to reduce vibration of the cooling shroud segment 200.

Exemplary embodiments of an annular combustor having inner cooling shroud segments and methods of using the same are described above in detail. The methods and systems described herein are not limited to the specific embodiments described herein, but rather, components of the methods and systems may be utilized independently and separately from other components described herein. For example, the methods and systems described herein may have other applications not limited to practice with turbine assemblies, as described herein. Rather, the methods and systems described herein can be implemented and utilized in connection with various other industries.

While the technical advancements have been described in terms of various specific embodiments, those skilled in the art will recognize that the technical advancements can be practiced with modification within the spirit and scope of the claims.

What is claimed is:

1. An annular combustor for a gas turbine, the annular combustor extending about a longitudinal axis and comprising:

an inner liner shell and an outer liner shell defining an interior volume, the annular combustor being configured to direct combustion gases in a gas flow direction through the interior volume from a forward end of the annular combustor to an aft end of the annular combustor;

a cooling shroud assembly attached at a distance radially inward of the inner liner shell, forming a cooling passage therebetween configured to direct cooling air in an air flow direction opposite to the gas flow direction during operation of the annular combustor, the cooling shroud assembly comprising a forward cooling shroud and an aft cooling shroud;

wherein the aft cooling shroud comprises and is assembled from individual cooling shroud segments circumferentially adjoined to each other;

wherein the distance between the cooling shroud segments and the inner liner shell is greater at a forward end of the cooling shroud segments than at the aft end of the cooling shroud segments;

wherein a first plurality of distributed fastening elements fastens the forward cooling shroud on the inner liner shell;

wherein a second plurality of distributed fastening elements fastens the cooling shroud segments on the inner liner shell, the plurality of distributed fastening elements being distributed across an axial length of the cooling shroud segments in circumferentially staggered rows; and wherein each fastening element of a set of forwardmost fastening elements of the second plurality of distributed fastening elements is disposed upstream from a curved portion at the forward end of each respective cooling shroud segment with respect to the air flow direction, and wherein the first plurality of distributed fastening elements is disposed downstream from the curved portion, with respect to the air flow direction.

2. The annular combustor of claim 1, wherein the curved portion of the forward end of each respective cooling shroud segment curves radially inward from the inner liner shell.

3. The annular combustor of claim 1, wherein the curved portion of the forward end of each respective cooling shroud segment is axially spaced from a zone-one cover ring defining a gap therebetween.

4. The annular combustor of claim 1, wherein the cooling shroud segments overlap each other in pairs in adjoining regions, and wherein each cooling shroud segment further comprises, along a first axial edge, overlapping elements that form an interlocking connection with a circumferentially adjacent cooling shroud segment.

5. The annular combustor of claim 1, wherein each of the cooling shroud segments defines cooling holes therethrough in axial alignment with the second plurality of distributed fastening elements, the cooling holes being configured to direct cooling air jets from radially inward of the respective cooling shroud segment and into the respective cooling passage.

6. The annular combustor of claim 1, wherein a surface of the inner liner shell comprises a plurality of brackets attached thereto, each bracket of the plurality of brackets being configured to engage a respective fastening element of the second plurality of fastening elements.

7. The annular combustor of claim 1, wherein the cooling shroud segments are disposed radially inward of a transition zone at the aft end of the annular combustor.

8. A gas turbine defining an axial centerline and a radial direction perpendicular to the axial centerline, the gas turbine comprising:

a compressor configured to produce a compressed air flow;

a turbine coupled to the compressor;

an annular combustor disposed between the compressor and the turbine, the annular combustor comprising:

an inner liner shell and an outer liner shell defining an interior volume, the annular combustor being configured to direct combustion gases in a gas flow direction through the interior volume from a forward end of the annular combustor to an aft end of the annular combustor;

a cooling shroud assembly attached at a distance radially inward of the inner liner shell, forming a cooling passage therebetween configured to direct cooling air in an air flow direction opposite to the gas flow direction during operation of the gas turbine, the cooling shroud assembly comprising a forward cooling shroud and an aft cooling shroud;

wherein the aft cooling shroud comprises and is assembled from individual cooling shroud segments circumferentially adjoined to each other;

wherein the distance between the cooling shroud segments and the inner liner shell is greater at the forward end of the cooling shroud segments than at the aft end of the cooling shroud segments;

wherein a first plurality of distributed fastening elements fastens the forward cooling shroud on the inner liner shell;

wherein a second plurality of distributed fastening elements fastens the cooling shroud segments on the inner liner shell, the second plurality of distributed fastening elements being distributed across an axial length of the cooling shroud segments in circumferentially staggered rows; and wherein each fastening element of a set of forwardmost fastening elements of the second plurality of distributed fastening elements is disposed upstream from a curved portion at the forward end of each respective cooling shroud segment with respect to the air flow direction, wherein the curved portion of the forward end of each respective cooling shroud segment extends at least partially parallel to the radial direction, and wherein the first plurality of distributed fastening elements is disposed downstream from the curved portion, with respect to the air flow direction.

9. The gas turbine of claim 1, wherein the curved portion of the forward end of each respective cooling shroud segment curves radially outward from the inner liner shell.

10. The gas turbine of claim 9, wherein the first radial segment of the curved portion of the forward end of each respective cooling shroud segment is axially spaced from a second radial segment of a zone-one cover ring defining a gap therebetween.

11. The gas turbine of claim 10, wherein the first radial segment is parallel to the second radial segment.

12. The gas turbine of claim 8, wherein the cooling shroud segments overlap each other in pairs in adjoining regions, and wherein each cooling shroud segment further comprises, along a first axial edge, overlapping elements that form an interlocking connection with a circumferentially adjacent cooling shroud segment.

13. The gas turbine of claim 8, wherein each of the cooling shroud segments defines cooling holes therethrough in axial alignment with the second plurality of distributed fastening elements, the cooling holes being configured to direct cooling air jets from radially inward of the respective cooling shroud segment and into the respective cooling passage.

14. The gas turbine of claim 8, wherein a surface of the inner liner shell comprises a plurality of brackets attached thereto, each bracket of the plurality of brackets being configured to engage a respective fastening element of the second plurality of fastening elements.

15. The gas turbine of claim 8, wherein the cooling shroud segments are disposed radially inward of a transition zone at the aft end of the annular combustor.

16. The gas turbine of claim 8, wherein the forward end of each respective cooling shroud segment terminates at the curved portion.

* * * * *